US009717935B2

(12) United States Patent
Kochelek

(10) Patent No.: US 9,717,935 B2
(45) **Date of Patent: *Aug. 1, 2017**

(54) VENTING ASSEMBLY FOR WET PIPE FIRE PROTECTION SPRINKLER SYSTEM

(71) Applicant: Engineered Corrosion Solutions, LLC, St. Louis, MO (US)

(72) Inventor: Jeffrey T. Kochelek, Creve Coeur, MO (US)

(73) Assignee: ENGINEERED CORROSION SOLUTIONS, LLC, St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/341,302

(22) Filed: Jul. 25, 2014

(65) Prior Publication Data

US 2015/0021052 A1 Jan. 22, 2015

Related U.S. Application Data

(60) Division of application No. 13/048,596, filed on Mar. 15, 2011, now Pat. No. 9,526,933, which is a (Continued)

(51) Int. Cl.
*A62C 35/00* (2006.01)
*A62C 35/68* (2006.01)
(Continued)

(52) U.S. Cl.
CPC ..... *A62C 35/68* (2013.01); *A62C 35/60* (2013.01); *A62C 35/62* (2013.01); *A62C 35/645* (2013.01);
(Continued)

(58) Field of Classification Search
CPC ..... A62C 35/68; A62C 35/60; A62C 35/645; A62C 35/62; Y10T 137/3115; Y10T 137/8634
(Continued)

(56) References Cited

U.S. PATENT DOCUMENTS 1,459,594 A 6/1923 McWhorter et al.
2,187,906 A 1/1940 Lowe
(Continued)

FOREIGN PATENT DOCUMENTS

CN 102661287 9/2012
DE 3938394 5/1991
(Continued)

OTHER PUBLICATIONS

Compressed Gas Technologies, Nitrogen Generator Specialists, 2009; 1 page; Retrieved online on Mar. 27, 2009 at http://www.nitrogen-generators.com.
(Continued)

*Primary Examiner* — Arthur O Hall
*Assistant Examiner* — Joel Zhou
(74) *Attorney, Agent, or Firm* — Harness, Dickey & Pierce, P.L.C.

(57) ABSTRACT

A wet pipe fire protection sprinkler system and method of operating a wet pipe fire sprinkler system includes providing a sprinkler system having a pipe network, a source of water for the pipe network, at least one sprinkler head connected with the pipe network and a drain valve for draining the pipe network. An inert gas source, such as a nitrogen gas source, is connected with the pipe network. Inert gas is supplied from the inert gas source to the pipe network. Water is supplied to the pipe network thereby substantially filling the pipe network with water and compressing the inert gas in the pipe network.

20 Claims, 9 Drawing Sheets

Related U.S. Application Data continuation-in-part of application No. PCT/US2009/056000, filed on Sep. 4, 2009, which is a continuation-in-part of application No. 12/210,555, filed on Sep. 15, 2008, now Pat. No. 9,144,700.

(60) Provisional application No. 61/357,297, filed on Jun. 22, 2010.

(51) Int. Cl.
*A62C 35/62* (2006.01)
*A62C 35/60* (2006.01)
*A62C 35/64* (2006.01)

(52) U.S. Cl.
CPC .... *Y10T 137/3115* (2015.04); *Y10T 137/8634* (2015.04)

(58) Field of Classification Search
USPC ..... 169/16
See application file for complete search history.

(56) References Cited

U.S. PATENT DOCUMENTS

| | | | | |
|---|---|---|---|---|
| 2,627,868 | A * | 2/1953 | Runnels | B60T 11/30 137/198 |
| 3,905,424 | A | 9/1975 | Elwood et al. | |
| 3,969,092 | A | 7/1976 | Huffman et al. | |
| 4,104,004 | A | 8/1978 | Graef | |
| 4,197,097 | A * | 4/1980 | Magorien | B01D 19/0063 116/276 |
| 4,991,655 | A | 2/1991 | McHugh | |
| 5,133,577 | A | 7/1992 | Schultze et al. | |
| 5,236,049 | A | 8/1993 | Asselin et al. | |
| 5,611,218 | A | 3/1997 | Naumovitz | |
| 5,803,180 | A | 9/1998 | Talley | |
| 5,845,714 | A | 12/1998 | Sundholm | |
| 6,024,116 | A | 2/2000 | Almberg et al. | |
| 6,076,278 | A | 6/2000 | Bradley | |
| 6,221,263 | B1 | 4/2001 | Pope et al. | |
| 6,293,348 | B1 | 9/2001 | Reilly | |
| 6,343,615 | B1 | 2/2002 | Miller et al. | |
| 6,390,203 | B1 | 5/2002 | Borisov et al. | |
| 6,415,870 | B1 | 7/2002 | Matsuoka | |
| 6,540,028 | B2 | 4/2003 | Wood | |
| 6,578,602 | B1 | 6/2003 | Kirschner | |
| 6,581,694 | B2 | 6/2003 | Golner et al. | |
| 6,601,653 | B2 | 8/2003 | Grabow et al. | |
| 6,666,277 | B2 | 12/2003 | Reilly | |
| 6,841,125 | B1 | 1/2005 | Chartier et al. | |
| 6,926,023 | B2 * | 8/2005 | Cabral | F17D 5/02 137/199 |
| 6,960,321 | B1 | 11/2005 | Ludwig | |
| 7,066,186 | B2 | 6/2006 | Bahr | |
| 7,104,336 | B2 | 9/2006 | Ozment | |
| 7,124,834 | B2 | 10/2006 | Sundholm et al. | |
| 7,389,824 | B2 | 6/2008 | Jackson | |
| 7,464,723 | B2 * | 12/2008 | Klein | F16K 17/06 137/524 |
| 7,481,238 | B2 | 1/2009 | Ramoth | |
| 7,594,545 | B2 | 9/2009 | Love | |
| 7,673,694 | B2 | 3/2010 | Wagner et al. | |
| 7,712,542 | B2 | 5/2010 | Munroe | |
| 7,717,776 | B2 | 5/2010 | Wagner et al. | |
| 7,845,424 | B1 | 12/2010 | Miller | |
| 7,921,577 | B2 | 4/2011 | Reilly et al. | |
| 8,105,051 | B2 | 1/2012 | Kusay et al. | |
| 8,122,968 | B2 | 2/2012 | Johnson | |
| 8,132,629 | B2 | 3/2012 | Reilly et al. | |
| 8,636,023 | B2 | 1/2014 | Burkhart et al. | |
| 8,720,591 | B2 | 5/2014 | Burkhart et al. | |
| 2007/0000258 | A1 | 1/2007 | Bonaquist et al. | |
| 2008/0277125 | A1 | 11/2008 | Wilkins et al. | |
| 2010/0044024 | A1 * | 2/2010 | Beeston | B21B 45/0233 165/185 |
| 2010/0065287 | A1 | 3/2010 | Burkhart et al. | |
| 2010/0263882 | A1 * | 10/2010 | Bodemann | A62C 35/62 169/17 |
| 2011/0000685 | A1 | 1/2011 | Matsuoka | |
| 2011/0108123 | A1 * | 5/2011 | Burkhart et al. | 137/2 |
| 2011/0226495 | A1 * | 9/2011 | Burkhart | A62C 35/62 169/16 |
| 2013/0098640 | A1 | 4/2013 | Burkhart et al. | |
| 2014/0338928 | A1 | 11/2014 | Mortensen et al. | |

FOREIGN PATENT DOCUMENTS

| | | |
|---|---|---|
| EP | 1074276 | 2/2001 |
| GB | 1081293 | 8/1967 |
| JP | 10234881 | 9/1998 |
| JP | 2003-90380 | 10/2003 |
| JP | 2005002977 | 1/2005 |
| JP | 2006247237 | 9/2006 |
| JP | 2008073227 | 4/2008 |
| WO | 2009/096035 | 8/2009 |

OTHER PUBLICATIONS

On Site Gas Systems, Copyright 2009; 2 pages; Retrieved online on Mar. 27, 2009 at http://www.onsitegas.com.

Potter Electric Signal; Sprinkler Monitoring Training Manual; National Fire Protection Associate [NFPA] and National Electric Manufacturers Association [NEMA]; 46 pages; Retrieved online on Mar. 27, 2009 at http://pottersignal.com/sprinkler_datasheets.aspx.

General Air Products; Dry Air Pac FM Approved Compressor Dryer Package for Critical Applications from Generators; Copyright 2009; 4 pages; Retrieved online on Mar. 27, 2009 at http://www.generalairproducts.com/fireprotection/content/view/16/88/.

General Air Products; Desiccant Dryers; 2 pages; Retrieved online on Mar. 27, 2009 at http://www.generalairproducts.com/pages2/desiccant-dryers.html.

Ansul Incorporated, Aquasonic™ Water-Atomizing Fire Suppression System, Data/Specifications, 4 pgs (2008).

Engineered Corrosion Solutions, Ejector Automatic Air Vent product information, 3 pages, Mar. 30, 2009.

Engineered Corrosion Solutions, Ejector Automatic Air Vent product information, 3 pages, Jul. 15, 2008.

O'Keefe Controls Co., Metal Orifice Assemblies product information, 6 pages, 2006.

Kinsley, Jr., George R., "Properly Purge and Inert Storage Vessels," CEP Magazine, Feb. 2001, pp. 57-61.

* cited by examiner

VENTING ASSEMBLY FOR WET PIPE FIRE PROTECTION SPRINKLER SYSTEM

CROSS REFERENCE TO RELATED APPLICATIONS

This application is a divisional of U.S. patent application Ser. No. 13/048,596 filed Mar. 15, 2011, which claims the benefit of U.S. Provisional Application No. 61/357,297 filed Jun. 22, 2010, and which is a continuation-in-part of International Patent Application No. PCT/US09/56000 filed Sep. 4, 2009, which claims the benefit and priority of U.S. patent application Ser. No. 12/210,555 filed Sep. 15, 2008. The entire disclosures of the above applications are incorporated herein by reference.

BACKGROUND OF THE INVENTION

The present invention is directed to anti-corrosion protection in a fire protection system and, in particular, to anti-corrosion in a wet pipe fire sprinkler system.

Wet pipe fire protection systems must be occasionally drained for maintenance, system upgrade, and the like. According to many fire protection codes, it is necessary to place the system back into operation daily, even if the maintenance or upgrade takes multiple days. Also, it is usually necessary to be able to place the system back into operation within a relatively short defined period that is usually measured in terms of a few minutes. This draining and refilling with water tends to create corrosion in the piping of the wet pipe fire sprinkler system. This is caused, at least in part, from the high oxygen content air that is introduced into the system upon refilling the system with water. Such corrosion can lead to system failure resulting in expensive repairs.

SUMMARY OF THE INVENTION

A wet pipe fire protection sprinkler system and method of operating a wet pipe fire sprinkler system, according to an aspect of the invention, includes providing a sprinkler system having a pipe network, a source of water for the pipe network, at least one sprinkler head connected with the pipe network and a drain valve for draining the pipe network. An inert gas source, such as a nitrogen gas source, is connected with the pipe network. Inert gas is supplied from the inert gas source to the pipe network. Water is supplied to the pipe network, thereby substantially filling the pipe network with water and compressing the inert gas in the pipe network.

At least some of the compressed gas may be vented from the pipe network. The compressed gas may be vented under particular circumstances, such as air pressure being above a particular pressure level, or for a particular time duration, or the like. Oxygen rich air may be prevented from entering the pipe network when emptying water from the pipe network.

Gas may be discharged from the pipe network after supplying inert gas and prior to said filling the system with water. The supplying and discharging of inert gas from said inert gas source to said pipe network may be repeated before supplying water to the pipe network, thereby increasing concentration of inert gas in the pipe network. The discharging of gas from the pipe network may include opening the drain valve.

The pipe network may include a riser, a generally horizontal main, at least one generally horizontal branch line connected to the main with the sprinkler head(s) being at the branch line. The venting may be performed at the main or branch line(s).

A venting assembly may be provided that is operable to vent air under particular circumstances, such as air pressure being above a particular pressure level. The pressure level may be fixed or adjustable. A gauge may be provided for setting an adjustable pressure level. The venting assembly may include an air vent and an airflow regulator. The air vent is connected with the pipe network and discharges to the airflow regulator. The air vent may further include a redundant air vent, with the air vent discharging to the airflow regulator through the redundant air vent. The airflow regulator may be in the form of a pressure relief valve, a back-pressure regulator, or a check valve. A sampling port may be provided for sampling air that is discharged from the airflow regulator.

Water may be drained from the pipe network by connecting the inert gas source to the pipe network and supplying inert gas to the pipe network during the draining in order to resist oxygen rich gas from entering the pipe network, such as through the drain valve.

A venting assembly is provided, according to another aspect of the invention, for use with a fire protection sprinkler system having a pipe network, a source of water for the pipe network, at least one sprinkler head connected with the pipe network and a drain valve for draining the pipe network. The sprinkler system may further include an inert gas source connected with the pipe network. The venting assembly includes an air vent and an airflow regulator. The air vent is adapted to be connected with the pipe network and adapted to vent gas, but not water. The airflow regulator is adapted to be connected with the air vent and is adapted to control gas flow to and/or from the air vent. The venting assembly may include a redundant air vent, with the air vent discharging to the airflow regulator through the redundant air vent. The airflow regulator may be in the form of a pressure relief valve, a back-pressure regulator or a check valve. A sampling port may be provided at the airflow regulator.

Embodiments of the present, fire protection system can also include a sprinkler system having at least one sprinkler, a source of pressurized water, and a piping network that includes a gas vent. The piping network couples the at least one sprinkler to a riser, where the riser is coupled to the source of pressurized water. A water reuse tank is coupled to the piping network via a gas vent line and is coupled to the riser or drain line via a water fill/drain line. The water fill/drain line includes a pump. The fire protection system also includes a source of nitrogen and a circulation line coupled at two positions to the water reuse tank, coupled to the water fill/drain line, and coupled to the source of nitrogen.

Methods of reducing corrosion in such fire protection systems can include the following aspects. Water is circulated through the circulation line to and from the water reuse tank while providing nitrogen from the source of nitrogen into the circulation line to deoxygenate the water. The deoxygenated water is pumped from the water reuse tank through the water fill/drain line, through the riser, and into the piping network. The water reuse tank may further be purged with nitrogen gas by providing nitrogen from the source of nitrogen into the circulation line, through the water reuse tank, through the gas vent line, through the piping network, and through the gas vent. The water reuse tank may further be filled with an amount of water from the source of pressurized water through the water fill/drain line to the circulation line while nitrogen from the source of nitrogen is provided into the circulation line. The amount of water can be sufficient to fill the piping network. The water may be circulated through the circulation line until the dissolved oxygen content in the water drops below a predetermined threshold to provide deoxygenated water. Nitrogen-enriched gas may also be provided through the gas vent line into at least a portion of the piping network while water is drained from at least a portion of the piping network through the riser and through the water fill/drain line into the water reuse tank.

These and other objects, advantages and features of this invention will become apparent upon review of the following specification in conjunction with the drawings.

DESCRIPTION OF THE PREFERRED EMBODIMENT

Figure 1:
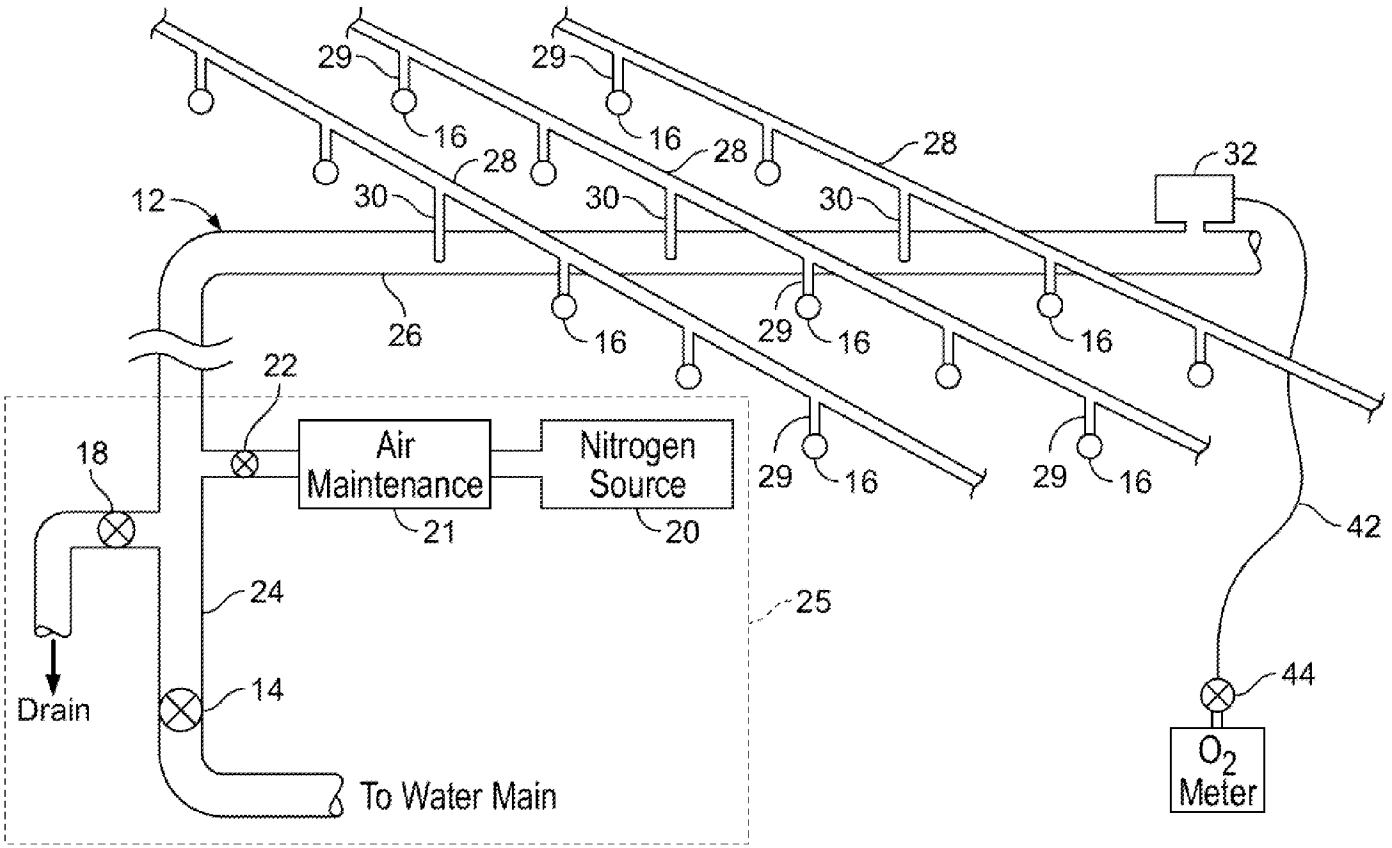
FIG. 1 is a schematic diagram of a wet pipe fire protection sprinkler system, according to an embodiment of the invention.

Referring now to the drawings and the illustrative embodiments depicted therein, a wet pipe fire protection sprinkler system 10 includes a pipe network 12, a source of water for the pipe network, such as a supply valve 14, one or more sprinkler heads 16 connected with the pipe network, a drain valve 18 for draining the pipe network and a source of inert gas, such as a nitrogen source 20 connected with the pipe network (FIG. 1). Nitrogen source 20 may include any type of nitrogen generator known in the art, such as a nitrogen membrane system, nitrogen pressure swing adsorption system, or the like. Such nitrogen generators are commercially available from Holtec Gas Systems, Chesterfield, Mo. Alternatively, nitrogen source 20 may be in the form of a cylinder of compressed nitrogen gas. Because such nitrogen cylinders are compressed to high pressures, an air maintenance device 21 may be provided to restrict flow and/or pressure supplied to pipe network 12 in order to prevent over-pressurization of the network. Alternatively, nitrogen source 20 may be a connection to a nitrogen system if one is used in the facility in which system 10 is located. Alternatively, nitrogen source 20 may be a transportable nitrogen generator of the type disclosed in commonly assigned U.S. patent application Ser. No. 61/383,546, filed Sep. 16, 2010, by Kochelek et al., the disclosure of which is hereby incorporated herein by reference.

Wet pipe fire sprinkler system 10 further includes a venting assembly 32 for selectively venting air from pipe network 12. In the illustrative embodiment, venting assembly 32 vents air and not water from the pipe network in order to remove at least some of the air from the pipe network when the pipe network is filled with water in the manner described in U.S. patent application Ser. No. 12/615,738, filed on Nov. 10, 2009, entitled AUTOMATIC AIR VENT FOR FIRE SUPPRESSION WET PIPE SYSTEM AND METHOD OF VENTING A FIRE SUPPRESSION WET PIPE SYSTEM, the disclosure of which is hereby incorporated herein by reference. Venting assembly 32 further prevents substantial air from entering pipe network 12 when the pipe network is drained of water in a manner that will be explained in more detail below. This avoids oxygen rich air from entering the pipe network at venting assembly 32 in response to a relative vacuum drawn on pipe network 12 by the draining of water, thereby displacing high nitrogen air in the pipe network. Venting assembly 32 may further be configured to vent air from the pipe network only under particular circumstances, such as air pressure in the pipe network being above a particular set point pressure level, thereby facilitating an inerting process, to be described in detail below, which may be carried out below the set point pressure level of the venting assembly. However, the venting may be based on other circumstances, such as based upon timing using a time-operated valve.

Pipe network 12 includes a generally vertical riser 24 to which drain valve 18 and supply valve 14 are connected and one or more generally horizontal mains 26 extending from riser 24. Drain valve 18, supply valve 14 and nitrogen source 20 may be conveniently located in a riser room 25 that is readily available to maintenance personnel. Pipe network 12 further includes a plurality of generally horizontal branch lines 28 connected with main 26, either above the main, such as through a riser nipple 30 or laterally from the side of the main. Sprinkler heads 16 extend from a branch line 28 via a drop 29.

In the illustrated embodiment, venting assembly 32 is connected with pipe network 12 at main 26 distally from the portion of the main that is connected with riser 24. This ensures that the main is vented. However, venting assembly 32 could be connected with a branch line 28. The venting assembly does not always need to be the highest point in pipe network 12. Venting assembly 32 does not need to be conveniently located in riser room 25 because its operation, once configured, is automatic so it does not need to be readily accessible to maintenance personnel.

Figure 2:
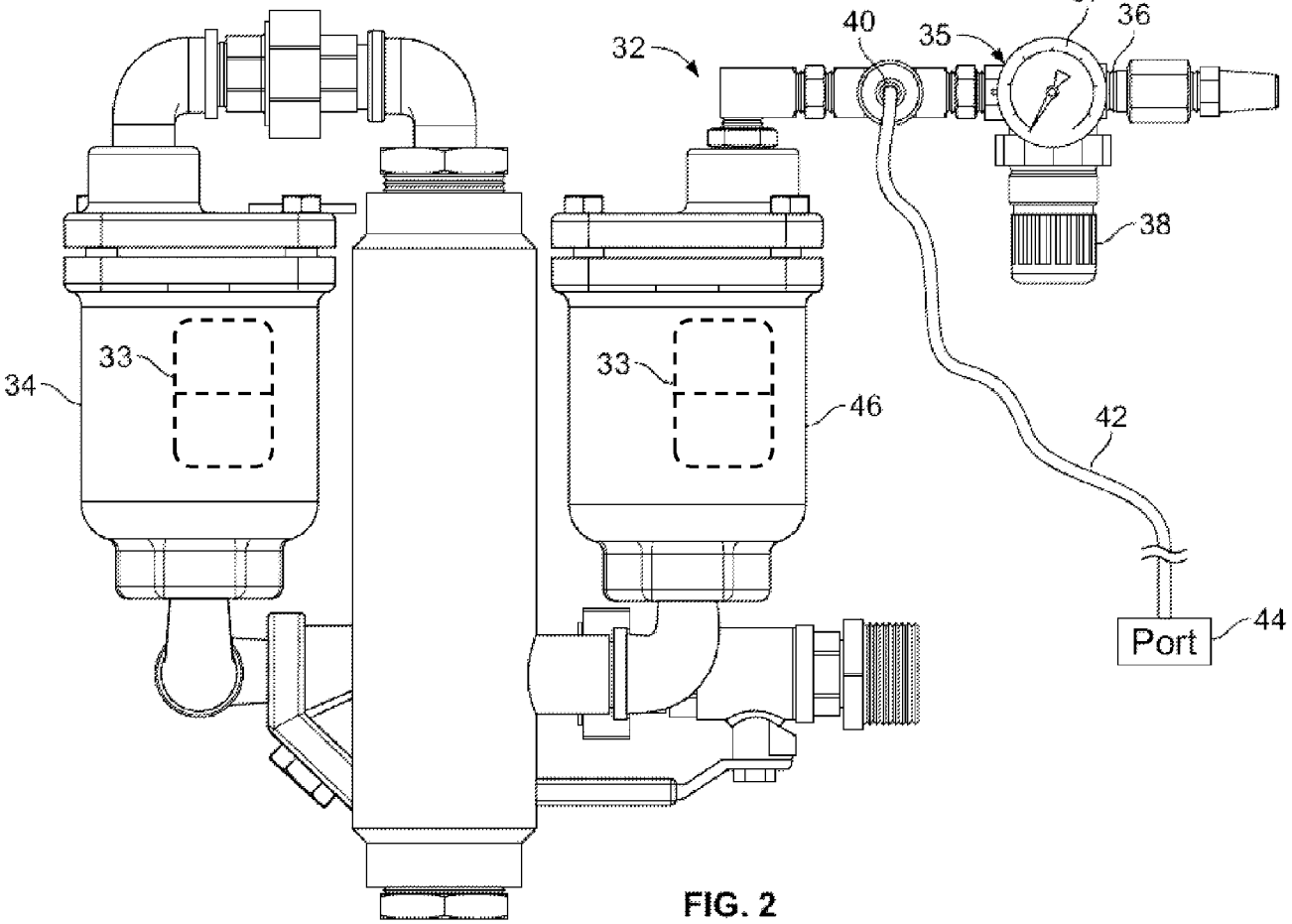
FIG. 2 is a front elevation of a venting assembly.

In the illustrated embodiment, venting assembly 32 is made up of an air vent 34 and an airflow regulator 35 (FIG. 2). Air vent 34 is connected with main 26 and discharges to airflow regulator 35. In embodiment illustrated in FIG. 2, airflow regulator 35 is in the form of a back-pressure regulator 36. Back-pressure regulator 36 responds to the pressure in main 26 by discharging air through air vent 34 that is above a set point pressure of the back-pressure regulator. In order to assist in field-setting the set point pressure, back-pressure regulator 36 includes a pressure gauge 37 that displays the pressure supplied to the back-pressure regulator and an adjustment knob 38 that allows the set point to be adjusted. In addition, a sample port 40 may be provided at back-pressure regulator 36 to allow the relative oxygen concentration (and, therefore, the nitrogen concentration) to be measured. Sample port 40 may be connected with a narrow gauge metal or plastic tube 42 to a port 44 at a more accessible location that is not in the floor or roof structure where fire sprinkler piping is generally located. Thus, by connecting an oxygen meter to port 44 at ground level, a technician can measure the relative oxygen/nitrogen makeup of the air being discharged from main 26 to determine if additional fill and purge cycles are necessary to adequately inert the fire sprinkler system piping.

Venting assembly 32 may further include a redundant air vent 46 that provides redundant operation in case of failure of primary air vent 34. Such redundancy avoids water from being discharged to back-pressure regulator 36 and to the environment upon failure of the primary air vent where it may cause damage before the failure is discovered. Such redundant air vent is as disclosed in U.S. patent application Ser. No. 12/615,738, filed on Nov. 10, 2009, entitled AUTOMATIC AIR VENT FOR FIRE SUPPRESSION WET PIPE SYSTEM AND METHOD OF VENTING A FIRE SUPPRESSION WET PIPE SYSTEM, the disclosure of which is hereby incorporated herein by reference. In particular, primary air vent 34 discharges to redundant air vent 46 which, in turn, discharges to back pressure regulator 36. The primary air vent 34 and/or the redundant air vent 46 may comprise a float 33. Also shown in FIG. 2, the primary and redundant air vents may have an identical configuration.

Alternatively, airflow regulator 35 can be made up of a pressure relief valve. A pressure relief valve functions in a similar manner to a back-pressure regulator, except that its set point is fixed at the factory and cannot be field adjusted. Alternatively, the airflow regulator can be in the form of a check valve which allows air to be discharged from air vent 34 to atmosphere, but prevents high oxygen content atmospheric air from being drawn through air vent 34 to main 26 when the pipe network is drained of water. Back-pressure regulator 36 and the alternative pressure relief valve are commercially available from multiple sources, such as Norgren Company of Littleton, Colo., USA.

Airflow regulator 35 operates by allowing air vented by air vent 34 to be discharged to atmosphere. However, airflow regulator 35 prevents atmospheric air, which is oxygen rich, from flowing through air vent 34 into pipe network 12, such as when it is being drained. In the illustrated embodiment in which airflow regulator 35 is made up of a back-pressure regulator or a pressure relief valve, airflow regulator 35 functions by opening above a set point pressure and closing below that set point pressure. Air vent 34 functions by opening in the presence of air alone (or other gaseous mixture) and closing in the presence of water. In this embodiment, venting assembly 32 will be open to vent gas from main 26 during filling of the fire sprinkler system with water which raises the pressure of the gas in pipe network 12 above the set point of the back-pressure regulator. Once substantially all of the gas is vented, the presence of water at air vent 34 will close the air vent resulting in closing of the back-pressure regulator. Then, when the fire sprinkler system is being emptied of water, the air pressure within main 26 will decrease as a result of water being drained, as would be understood by the skilled artisan, thereby maintaining airflow regulator 35 closed to prevent drawing in a substantial amount of high oxygen content atmospheric air. This will prevent substantial amounts of oxygen rich atmospheric air from entering pipe network 12 during draining of sprinkler system 10 of water.

Figure 3:
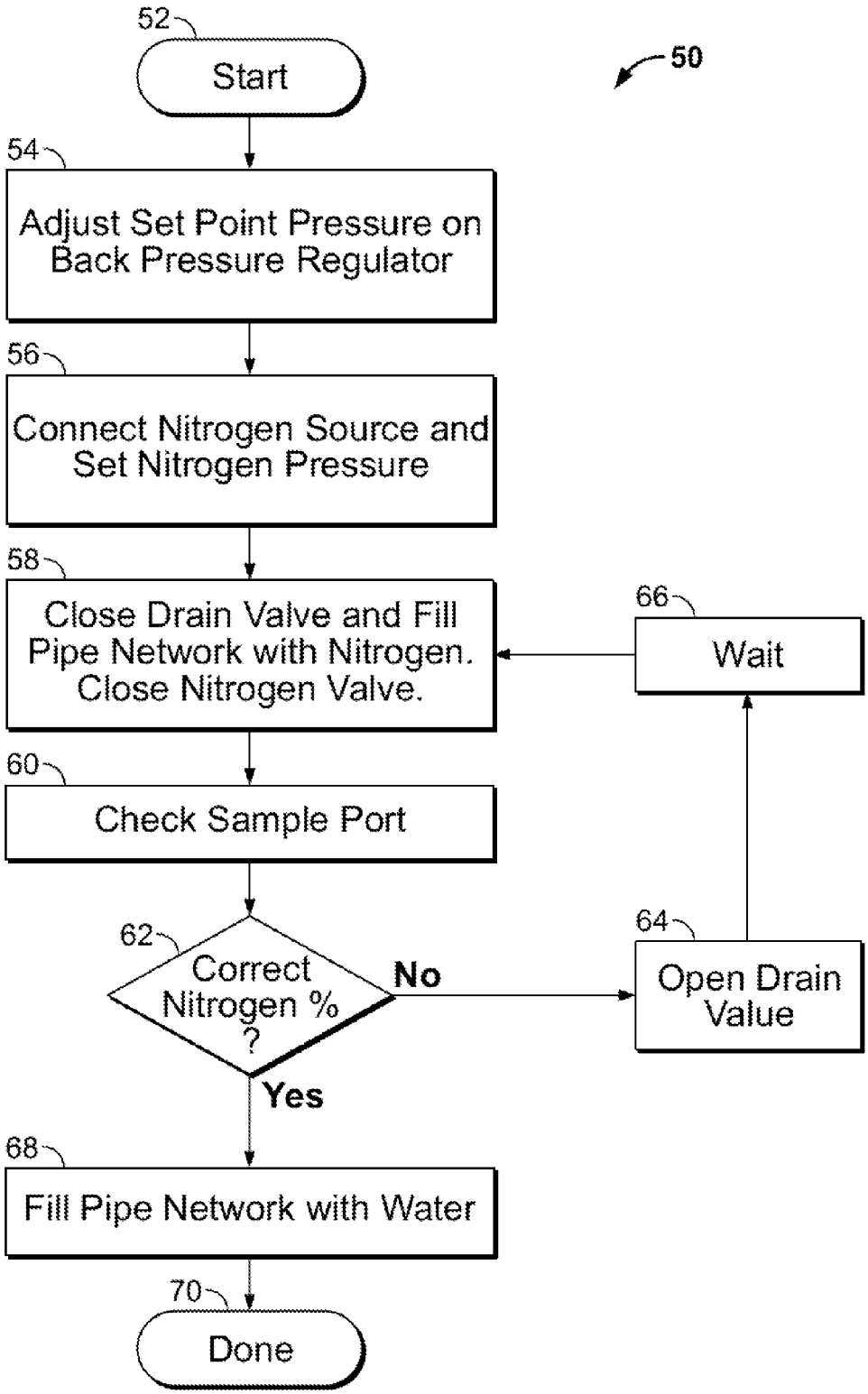
FIG. 3 is a flow diagram of an inerting process.
Figure 4:
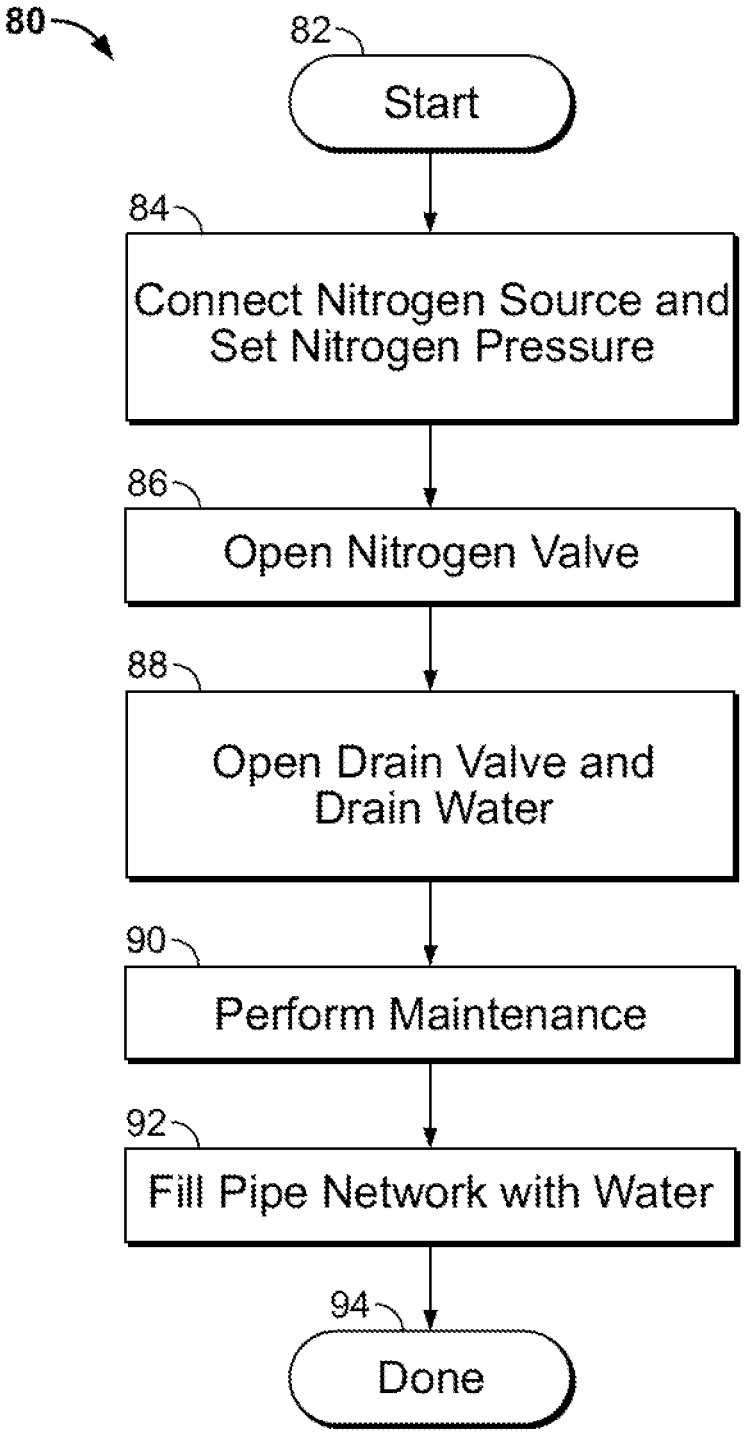
FIG. 4 is a flow diagram of a drain and refill process.

The wet pipe fire sprinkler system operates as follows. When system 10 is initially set up or undergoes extensive maintenance, an inerting process 50 is carried out with nitrogen or other inert gas (FIG. 3). Process 50 starts (52) by the technician setting (54) the set point pressure on back-pressure regulator 36. Nitrogen source 20 is connected with pipe network 12, such as to riser 24, and nitrogen pressure of air maintenance device 21 is set (56). Typically, the nitrogen pressure is set below the set point pressure of back-pressure regulator 36 to prevent back-pressure regulator 36 from opening during inerting process 50. For example, nitrogen pressure may be set to approximately 30 PSIG and set point pressure of back-pressure regulator set to approximately 50 PSIG. Drain valve 18 is closed and nitrogen valve 22 opens to fill pipe network 12 with nitrogen rich air (58). Nitrogen valve 22 is then closed to prevent additional gas injection. The technician may then sample the relative concentration of oxygen and nitrogen at sample port 40 by opening port 44 and allowing air to flow through tube 42 for a sufficient time, such as several minutes, to allow levels to stabilize (60). A manual or automatic oxygen meter can then be connected to port 44 to achieve continuous or intermittent oxygen readings. Nitrogen concentration may be inferred at 60 by subtracting the oxygen concentration percentage from 100%.

It is then determined if the nitrogen concentration is at a desired level (62). If it is not, drain valve 18 is opened (64). After a delay (66) to allow pressure in pipe network 12 to drop to atmospheric pressure, the drain valve is again closed and steps 58 through 62 repeated until it is determined at 62 that the concentration of nitrogen in the pipe network is high enough. It should be understood that steps 60 and 62 are optional and may be eliminated once process 50 has been performed one or more times. Once it is determined at 62 that the nitrogen concentration is sufficient, source valve 14 is then opened (68) to admit water to the pipe network. The relatively high pressure of the water, such as between approximately 76 PSIG and 150 PSIG, compresses the nitrogen rich air in pipe network 12 to a fraction of its volume and raises the pressure of the air above the set point of back-pressure regulator 36. This causes back-pressure regulator 36 to discharge the nitrogen rich air until essentially all of the air is depleted from the system at which time air vent 34 closes in the presence of water. Back-pressure regulator 36 then closes to prevent high oxygen rich air from entering the pipe network when it is subsequently drained of water.

Once inerting process 50 is carried out, wet pipe sprinkler system 10 may be able to be drained and refilled using a drain and refill process 80 without the need to repeat inerting process 50. Drain and refill process 80 begins (82) with system 10 filled with water either using inerting process 50 or by a conventional process. Nitrogen source 20 is connected with riser 24 and the nitrogen pressure adjusted (84), such as by adjusting air maintenance device 21. Nitrogen valve 22 is opened (86) in order to allow nitrogen gas to flow into the riser. Drain valve 18 is opened (88) to drain water from the pipe network. When the pressure in the riser falls below the nitrogen pressure, nitrogen gas will enter the riser to resist high oxygen rich air from entering the riser through drain valve 18 in response to a vacuum that occurs as the piping network is emptied of water. The airflow regulator of venting assembly 32 will prevent a substantial amount of oxygen rich air from entering main 26 through air vent 34. Once any maintenance is performed at 90 the pipe network can be refilled with water at 92. Any air in pipe network 12 will be discharged through venting assembly 32 in the manner previously described.

By varying the purity of the source of nitrogen gas, the fill pressure and the number of times that steps 58 through 62 are repeated, the concentration of nitrogen can be established at a desired level. For example, by choosing a nitrogen source of concentration between 98% and 99.9% and by filling and purging the piping network at approximately 50 PSIG for four (4) cycles, a concentration of nitrogen of between 97.8% and 99.7% can be theoretically achieved in system 10. A fewer number of cycles will result in a lower concentration of nitrogen and vice versa.

Inerting of sprinkler system 10 with nitrogen or other inert gas tends to result in an inert-rich gas present in branch lines 28 and riser nipples 30 because oxygen rich air that may enter during the draining of the system tends to stay relatively close to drain valve 18 and not enter the branch lines or riser nipples. Depending on fire protection system design, venting assembly 32 may be positioned at main 26 or at one or more branch lines 28. Also, venting assembly 32 should be positioned away from the nitrogen source connection to pipe network 12. Although illustrated as connected with riser 24, nitrogen source 20 can be connected at other portions of the pipe network.

The wet pipe fire protection sprinkler system and method of operation disclosed herein provides many advantages as would be understood by the skilled artisan. The filing of pipe network 12 with water either during or after it is filled with high nitrogen air tends to reduce corrosion in pipe network 12. This is because most air is removed from the pipe network and the amount that remains is low in oxygen. It is further believed that only a small amount of oxygen is supplied with the water. Because corrosion is believed to begin primarily at the water/air interface in a wet pipe fire sprinkler system and little oxygen is present in the high nitrogen environment, corrosion formation is inhibited.

Moreover, a high nitrogen, or other inert gas, wet pipe fire protection sprinkler system may be provided in certain embodiments without the need to apply a vacuum to the system after draining in order to remove high oxygen air. This reduces the amount of time required to place the system back into operation after being taken down for maintenance. Maximum time of restoration is often dictated by code requirements and may be very short. Also, the elimination of a vacuum on the system avoids potential damage to valve seals, and the like, which allows a greater variety of components to be used in the fire sprinkler system.

Variations will be apparent to the skilled artisan. For example, although illustrated with a single riser and main, it should be understood that multiple risers and/or mains may be used particularly with multiple story buildings, as disclosed in commonly assigned International Patent Application Publication No. WO 2010/030567 A1 entitled FIRE PROTECTION SYSTEMS HAVING REDUCED CORROSION, the disclosure of which is hereby incorporated herein by reference. Also, while water source 14 may be city water mains, it may, alternatively, include a water reuse tank, as also disclosed in such international patent application publication. Such water reuse tank reduces the size of the nitrogen source by conserving water that is relatively high in dissolved nitrogen and relatively low in dissolved oxygen.

Figure 5:
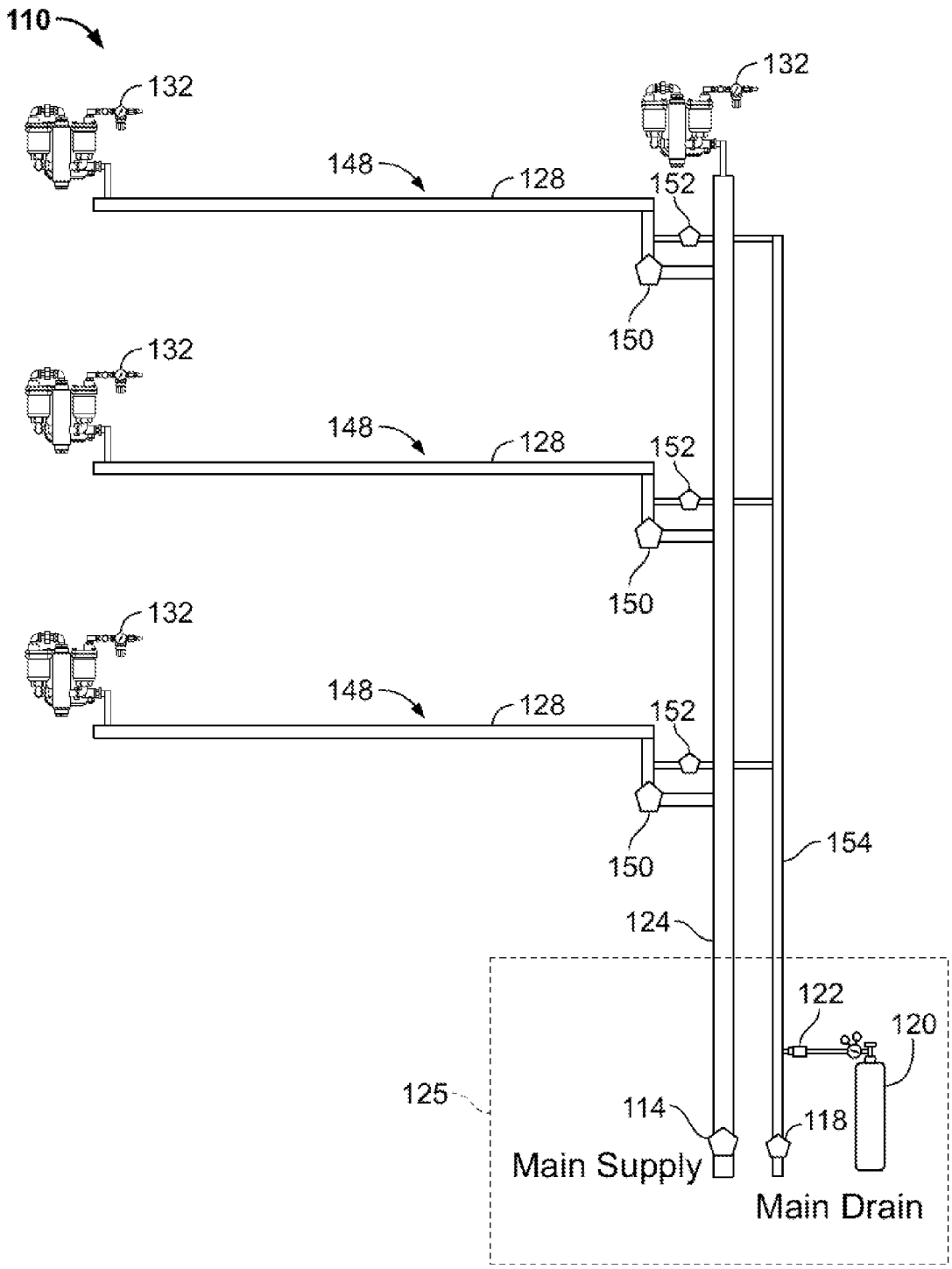
FIG. 5 is a schematic diagram of a multiple-zone wet pipe fire protection sprinkler system.
Figure 6:
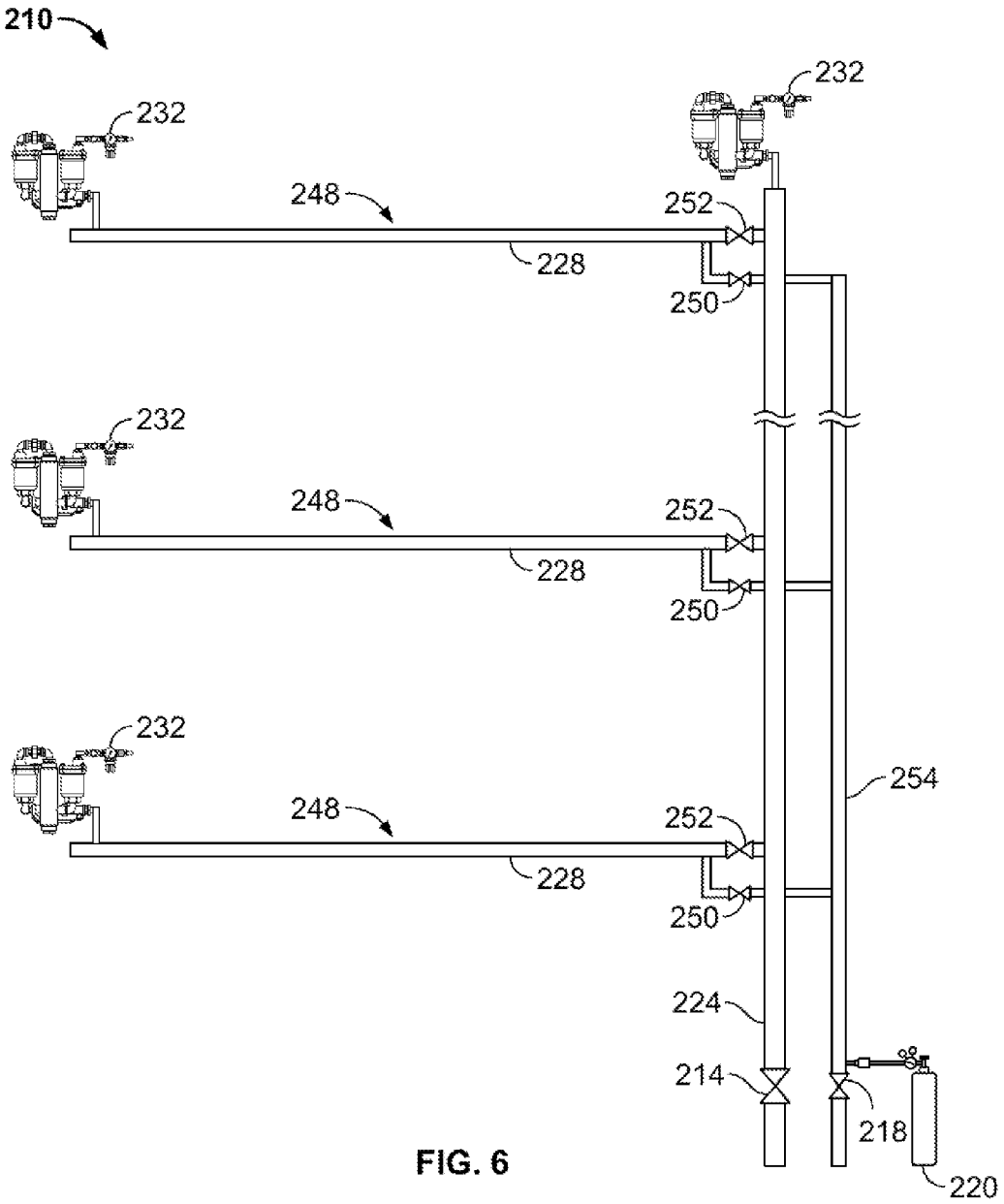
FIG. 6 is the same view as FIG. 5 of an alternative embodiment thereof.

In an alternative embodiment, a multiple-zone fire protection sprinkler system 110 that is illustrated for use with a multiple story building, but could, likewise, be used in a large protected space on a single story, includes a main supply valve 114 connected with a combination supply riser 124 that feeds a plurality of zones 148, each having a branch line 128 and a venting assembly 132 at a distal end of the branch line with respect to the riser (FIG. 5). Sprinkler heads (not shown) are connected with branch line 228. Venting assembly 132 may be the same as venting assembly 32. System 110 may additionally include a venting assembly 132 at an upper portion of riser 124. Each branch line 128 is connected with riser 124 via a zone supply valve which, in the illustrated embodiment, is a manual valve. Each branch line 128 is connected with a drain riser 154 via a zone drain valve 152. A source of inert gas, such as a nitrogen source 120, is connected with drain riser 154 via a fitting, such as a quick disconnect 122. The nitrogen source may be any of the types previously set forth.

In operation, one or more of the zones 148 can be accessed, such as for maintenance, while the other zones remain in operation, by closing the supply valve 150 for that zone(s) and opening the zone drain valve 152 for that zone(s). After the water is drained, main drain valve 118 is closed and nitrogen source 120 is operated to apply nitrogen to drain riser 154. When the zone(s) is filled with nitrogen gas, the nitrogen source is cut off and drain valve 118 is opened to allow the zone to relax to atmospheric pressure, as provided in procedure 50 (FIG. 3). When the procedure set forth in FIG. 3 is complete, that zone (3) is inerted. Zone drain valve 152 is closed and zone supply valve 150 is opened resulting in water again filling branch line 128 and the excess gas being expelled via venting assembly 132. Because venting assembly 132 does not allow significant amounts of oxygen rich air to be drawn into the zone when it is drained, drain and refill process 80 may be used to perform future maintenance on that zone(s). An inerting process may be used to inert riser 124 using venting assembly 132.

Thus, it can be seen that multiple zone fire protection sprinkler system 110 can be inerted one or more zones at a time while leaving other zones in service. Only one nitrogen source and gas injection port are required and they can be located in a riser room 125.

Figure 7:
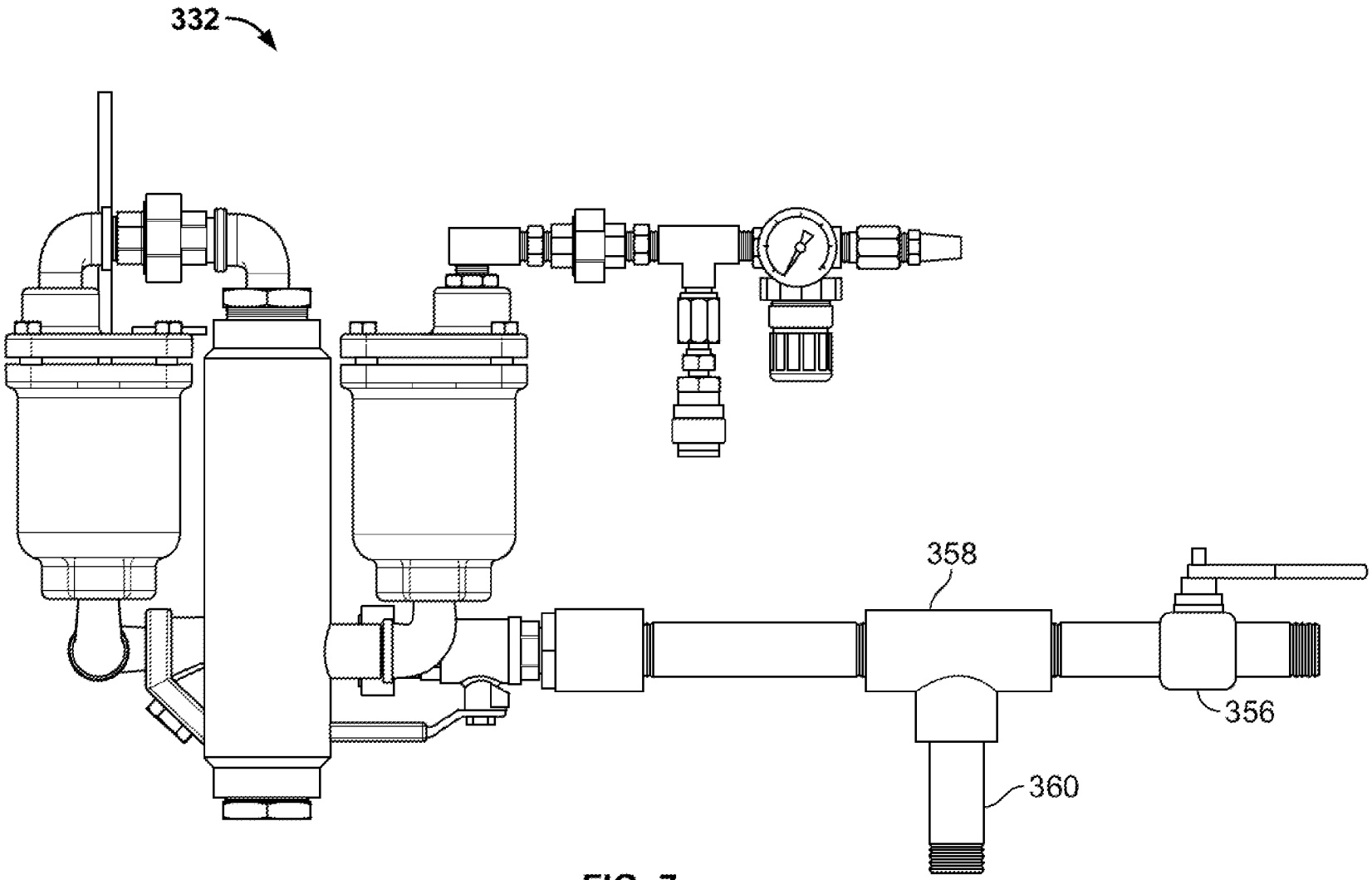
FIG. 7 is a front elevation of an alternative venting assembly.

An alternative venting assembly 332 may be provided for each zone to provide an alternative technique for venting the gas to atmosphere between inerting steps (FIG. 7). Assembly 332 includes a manual vent, such as a valve 356, that is connected via a Tee 358 to a connection 360 extending from riser 148 (not shown in FIG. 7). After the zone is filled with inert gas and the source of inert gas is cut off, manual vent 156 may be opened in order to perform method step 64 rather than opening drain valve 118.

In another alternative embodiment, a multiple zone fire protection sprinkler system 210 includes a plurality of zones 248, each including at least one branch line 228 connected with a zone supply valve 250 with a supply riser 224 and through a zone drain valve 252 to a drain riser 254. Each zone includes a venting assembly 232, similar to venting assembly 132 or 332, at a distal end of the branch line. A venting assembly 232 may also be provided for riser 224. System 210 is similar to system 110, except that supply valves 250 and drain valves 252 are electrically controlled, such as from a control panel or programmable controller (not shown). Also, system 210 may include a main supply valve 214 and drain valve 218, either or both of which may be electrically controlled. In this fashion, the inerting of zones 248 may be carried out either remotely or automatically thereby avoiding the need for a technician to visit the zone(s) being emptied and refilled. Other modifications will be apparent to the skilled artisan.

Figure 8:
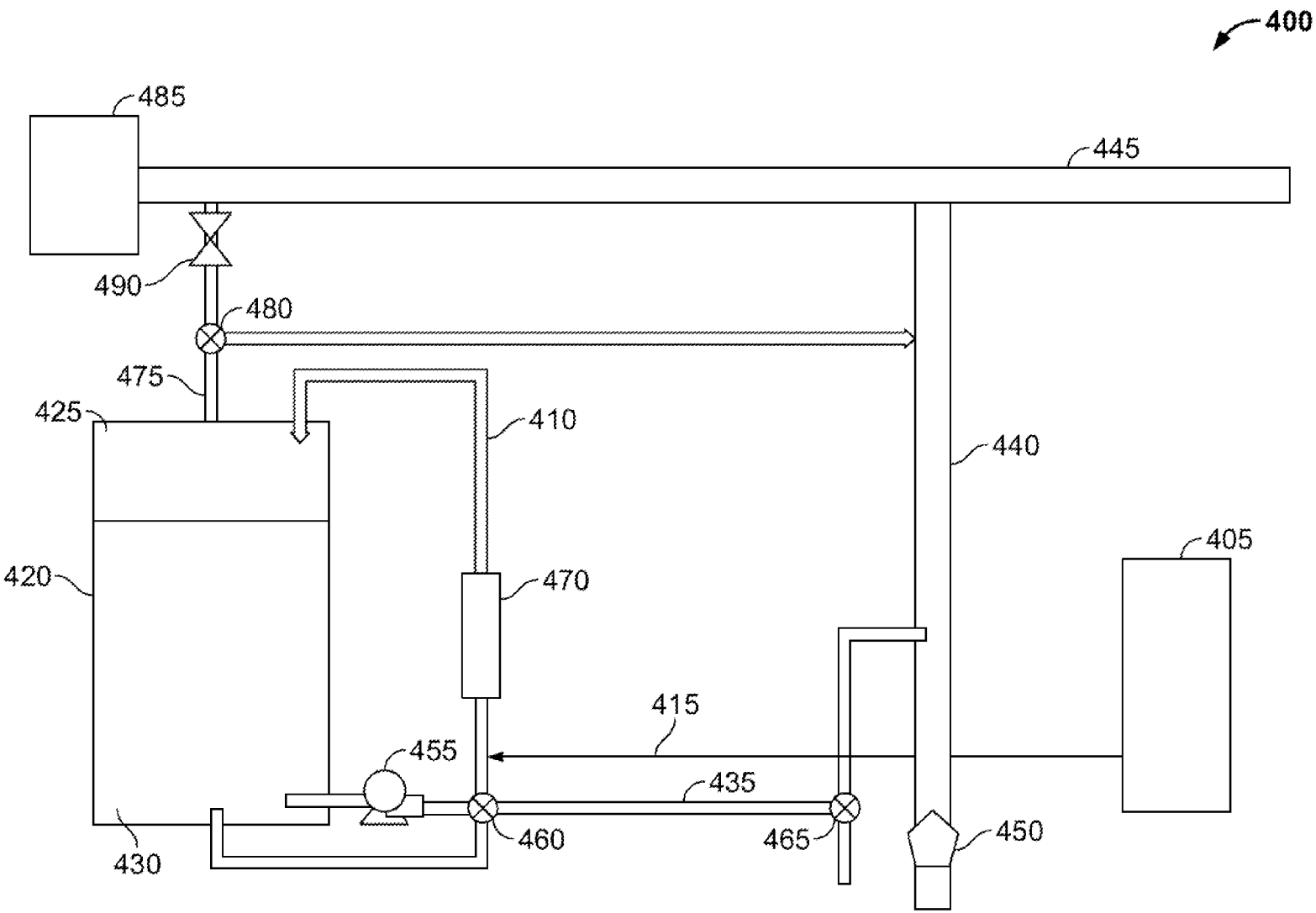
FIG. 8 is a schematic diagram of a wet pipe fire protection sprinkler system having a water recycling tank.

In another embodiment, a wet pipe fire protection sprinkler system 400 uses an inert gas, such as nitrogen gas, to control corrosion. System 400 and can be operated and/or tested according to the following aspects, which include filling, draining, and refilling of the system. With reference to FIG. 8, a portion of a fire protection sprinkler system 400 is shown. The fire protection sprinkler system 400 includes a nitrogen generator 405, where the nitrogen generator 405 may also be configured with a compressor and nitrogen storage tank. The nitrogen generator 405 is coupled to a circulation line 410 via a nitrogen injection line 415. The circulation line 410 runs to and from a water reuse tank 420 having a gas volume 425 and a liquid water volume 430. The circulation line 410 is further coupled to a water fill/drain line 435, where the water fill/drain line 435 is coupled to the water reuse tank 420 and to a riser 440 running to a piping network 445 of a wet pipe sprinkler system. The water fill/drain line 435 can be split so that it is coupled to the riser 440 and can run to a drain. A pump 455, such as a centrifugal pump, is positioned in the water fill/drain line 435 between the water reuse tank 420 and the coupling with the circulation line 410.

A valve 460 is positioned at the point where the circulation line 410 is coupled to the water fill/drain line 435. The valve 460 is operable to open or close water flow between the water reuse tank 420 through the water fill/drain line 435 to the riser 440. The valve 460 is also operable to open or close water flow in the circulation line 410 running to and from the water reuse tank 420. Another valve 465 is positioned at the split of the water fill/drain line 435 before coupling to the riser 440 and to the drain. The valve 465 is operable to open or close water flow through to the water fill/drain line 435 to the coupling between the system control valve 450 and the piping network 445, or to open or close water flow through the water fill/drain line 435 to the drain.

A means for mixing nitrogen gas and water, such as an in-line static mixer 470, is positioned in the circulation line 410 between the coupling with the nitrogen injection line 415 and the portion of the circulation line 410 running to the water reuse tank 420. The in-line static mixer 470 is operable to mix a stream of nitrogen gas from the nitrogen injection line 415 from the nitrogen generator 405 with water flow in the circulation line 410. Addition of nitrogen gas can force or strip dissolved oxygen from the water where it collects within the gas volume 425 of the water reuse tank 420, leaving the liquid water volume 430 with a reduced dissolved oxygen content or, substantially no dissolved oxygen content.

A gas vent line 475 is coupled to the gas volume 425 portion of the water reuse tank 420 and to one or both of the risers 440 and the piping network 445. A valve 480 is positioned in the gas vent line 475 where it splits from the water reuse tank 420 to the riser 440 and the piping network 445. The valve 480 is operable to open or close gas flow between the gas volume 425 of the water reuse tank 420 through the gas vent line 475 to the riser 440, or to open or close gas flow between the gas volume 425 of the water reuse tank 420 through the gas vent line 475 to the piping network 445. A check valve 490 is positioned in the gas vent line 475 at or before the coupling to the piping network 445. A similar check valve (not shown) can also be positioned at or before the coupling of the gas vent line 475 to the riser 440. The check valve 490 operates to prevent water from the piping network 445 from entering the gas vent line 475, for example, once the piping network 445 of the wet pipe sprinkler system is filled with water.

A gas vent 485, which may be similar to venting assembly 32, 332, is positioned in the piping network 445 and is operable to vent gas from the piping network 445. Additional gas vents can also be positioned at various points throughout the piping network, typically at or near terminal points within the network. The gas vent 485 may be configured to vent gas only and prevent the venting of water.

Operation of system 400 can include the following aspects. The piping network 445 of the wet pipe sprinkler system can be filled with deoxygenated water (e.g., nitrogen-enriched water). The water reuse tank 400, which may be empty, is purged with nitrogen gas, where nitrogen-enriched gas can be vented into the piping network 445 of the fire protection system, affording positive displacement of gas within the system with gas exiting out of the gas vent(s) 485. The venting may be performed in a continuous fashion or at one or more selected times or intervals. Water supply line pressure is used to fill the water reuse tank 420 with water (if empty) through the circulation line 410 using the nitrogen injection line 415 and mixing of nitrogen gas with water via the inline static mixer 470, where water can be supplied to the circulation line 410 via the water fill/drain line 435 and riser 440.

Once the water reuse tank 420 has enough water to fill the wet pipe sprinkler system piping network 445, filling is stopped and the water within the liquid water volume 430 of the water reuse tank 420 is circulated. Nitrogen gas injection may be continued during water circulation until the dissolved oxygen content in the water falls below about 1.0 ppm, for example. At this point, the gas vent line valve 480 is closed, circulation of water is stopped, and the centrifugal pump 455 is used to fill the piping network 400 of the wet pipe sprinkler system with deoxygenated water. The deoxygenated water is pumped from the water reuse tank 420 into the piping network 445 using the centrifugal pump 455 via the water fill/drain line 435 and riser 440. Nitrogen injection may be continued in order to fill the gas volume space 425 in the water reuse tank 420 as water is emptied to fill the piping network 445.

The wet pipe sprinkler system piping network 445 can be drained to permit servicing or testing of the fire protection sprinkler system. The gas vent line 475 is opened to allow nitrogen-enriched gas from the gas volume 425 of the water reuse tank 420 to fill void space created in the piping network 445 as the system is drained of water. Water is drained from the piping network 445 into the water reuse tank 420 via the water fill/drain line 435 coupled to the riser 440 until the piping network 445 is essentially empty and substantially all of the water is captured in the water reuse tank 420. The water may be drained from the piping network 445 into the water reuse tank 420 using gravity or a pump 455. The piping network 445 of the wet pipe sprinkler system can then be refilled with the captured water from the liquid water volume 430 in the water reuse tank 420, where the water may already be sufficiently deoxygenated or may be further deoxygenated using the nitrogen generator 405 and in-line static mixer 470 and circulating the water in the water reuse tank 420 via the circulation line 410 and pump 455.

Figure 9:
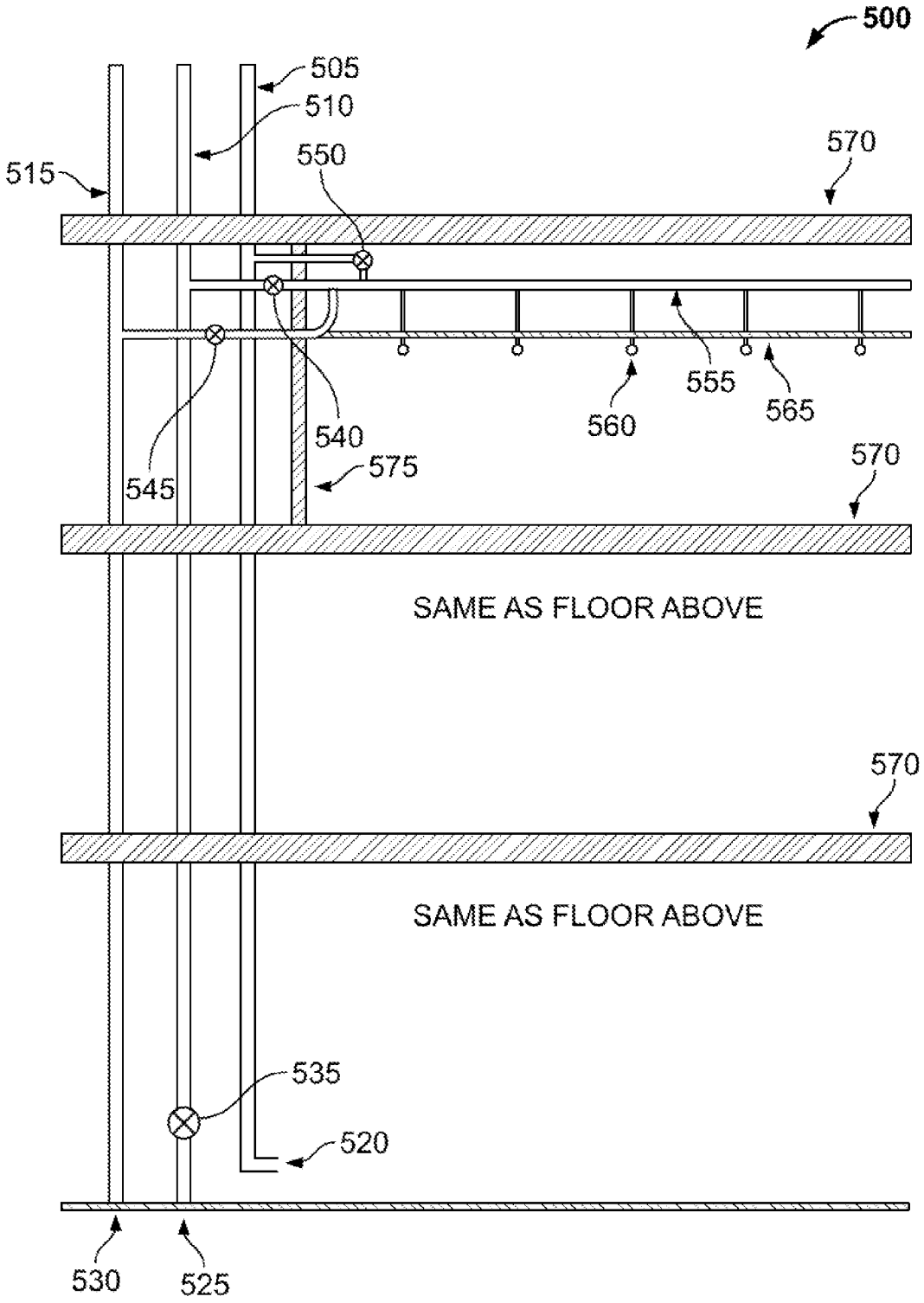
FIG. 9 is the same view as FIG. 5 of another alternative embodiment thereof.

An alternative embodiment of a multiple zone fire protection sprinkler system 500 that, for example, may be installed in structures having more than one level or floor, includes a riser for delivering water that runs from the main sprinkler equipment room to each floor to be protected, where a piping network is coupled to the riser at each floor (FIG. 9). The riser may provide pressurized water to the piping network on each floor and may also be used to drain water from the piping network(s). For example, the source of pressurized water to the riser may be shut off using a valve and the riser drained of water where one or more of the piping networks on one or more floors are also drained of water through the riser. The riser may, therefore, supply pressurized water to the piping network(s) and may be used to drain the piping network(s). In addition, when the piping network(s) and riser are drained of water, the riser may be used to provide nitrogen from a nitrogen generator or a nitrogen storage tank into the riser and various piping networks. In the illustrated embodiment, wet pipe fire protection sprinkler system 500 may be drained at the riser, and piping networks can optionally be evacuated, such as with a vacuum pump, fast-filled with nitrogen, and refilled with water as described.

Fire protection sprinkler system 500 can further include a drain line in addition to the riser. In such cases, the riser can provide pressurized water to the piping networks on the various floors and the drain line can be used to drain the piping networks. Valves in the couplings between the piping networks, riser, and drain line can be used to isolate portions of the fire protection system and allow draining/filling of the entire system or just portions of the system. For example, pressurized water entering the piping network on one floor may be shut off via a valve and a valve to the drain line opened to drain only this particular isolated piping network. In this way, the piping network on one floor may be serviced while pressurized water can still be provided to the piping networks on the other floor(s) via the riser. In addition, the piping network(s) can be drained of water using the drain line while the pressurized water from the riser is isolated using a valve. The drained piping network(s) can then be evacuated through the drain line using a vacuum pump and fast-filled with nitrogen. The valve to the piping network(s) from the riser is then opened to refill the piping network with water in the case of a wet pipe system.

Fire protection sprinkler system 500 can still further include a gas line in addition to the riser and the drain line. The riser provides pressurized water to the piping networks on the various floors, the drain line can be used to drain the piping network(s), and the gas line can provide nitrogen into the piping network(s). Valves in the couplings between the piping networks, riser, drain line, and gas line can be used to isolate portions of the fire protection system and allow draining/filling of the entire system or just portions of the system. The piping network(s) can be drained of water using the drain line while the pressurized water from the riser is isolated using a valve. The drained piping network(s) can then be used to evacuate the air in the piping through the drain line or through the gas line using a vacuum pump and fast-filled with nitrogen supplied via the gas line. The valve to the piping network(s) from the riser is then opened to refill the piping network with water in the case of a wet pipe system. The gas line may also be used to provide compressed air in addition to nitrogen, for example.

With reference to FIG. 9, a cross-section view of a portion of a fire protection system 500 for protecting a structure having multiple floors is shown. A gas line 505, riser 510, and drain line 515 are coupled to piping networks 555 on multiple floors of a structure. A source inert gas, such as nitrogen, and optionally compressed air is coupled to the gas line 505 at 520, a source of pressurized water is coupled to the riser 510 at 525, and a drain and/or water reuse tank is coupled to the drain line 515 at 530; these features may be located in a main equipment room (not shown). A valve 535 can control flow of pressurized water through the riser 510. Couplings of the gas line 505, riser 510, and drain line 515 to each of the piping networks 555 can include a sprinkler control valve 540, sprinkler drain valve 545, and gas connection valve 550, as shown.

Piping network(s) 555 and associated portions of the fire protection system may be positioned behind walls 575 and finished ceilings 565 where the sprinkler heads 560 are exposed to the area to be protected on each floor 570. The gas line 505, riser 510, and drain line 515 can traverse multiple floors 570 and connect to one or more piping networks 555 configured as necessary to protect each floor 570.

Changes and modifications in the specifically described embodiments can be carried out without departing from the principles of the invention which is intended to be limited only by the scope of the appended claims, as interpreted according to the principles of patent law including the doctrine of equivalents.

The invention claimed is:

1. A venting assembly for use with a wet pipe fire protection sprinkler system, the wet pipe fire protection sprinkler system having a pipe network, a source of water for the pipe network, and at least one sprinkler head connected with the pipe network, the venting assembly comprising:

a primary air vent adapted to be connected with the pipe network and vent gas but not water from the pipe network;

a redundant air vent coupled to the primary air vent and adapted to vent gas but not water from the pipe network; and an airflow regulator adapted to control gas flow between the primary air vent and atmosphere;

wherein the primary air vent is configured to discharge gas to the redundant air vent;

wherein the redundant air vent is configured to discharge gas to the airflow regulator;

wherein the airflow regulator is configured to discharge gas to atmosphere when a gas pressure in the pipe network is above a set point pressure level; and wherein the airflow regulator is configured to substantially prevent atmospheric air from entering the redundant air vent while the pipe network is drained of water.

2. The venting assembly of claim 1, further comprising at least one of a cutoff valve and a Y-strainer configured to be coupled to the pipe network.

3. The venting assembly of claim 1, wherein at least one of the primary air vent and the redundant air vent comprises a float.

4. The venting assembly of claim 1, wherein the primary air vent and the redundant air vent each comprise a float.

5. The venting assembly of claim 1, wherein the primary air vent and the redundant air vent have an identical configuration.

6. The venting assembly of claim 1, wherein the set point pressure level is adjustable.

7. The venting assembly of claim 1, wherein the set point pressure level is approximately 50 psig.

8. The venting assembly of claim 1, wherein the airflow regulator comprises a back-pressure regulator.

9. The venting assembly of claim 8, wherein the back-pressure regulator has an adjustable set point pressure and includes a pressure gauge.

10. The venting assembly of claim 1, further comprising a sample port for sampling gas discharged by the airflow regulator to atmosphere.

11. The venting assembly of claim 1, wherein the airflow regulator comprises a pressure relief valve.

12. The venting assembly of claim 1, wherein the airflow regulator comprises a check valve.

13. The venting assembly of claim 3, wherein the primary air vent and the redundant air vent each comprise a float.

14. The venting assembly of claim 13, further comprising at least one of a cutoff valve and a Y-strainer configured to be coupled to the pipe network.

15. The venting assembly of claim 14, wherein the primary air vent and the redundant air vent have an identical configuration.

16. The venting assembly of claim 14, wherein the set point pressure level is adjustable.

17. The venting assembly of claim 14, wherein the set point pressure level is approximately 50 psig.

18. The venting assembly of claim 14, wherein the airflow regulator comprises a check valve.

19. The venting assembly of claim 14, wherein the airflow regulator comprises a pressure relief valve.

20. The venting assembly of claim 14, wherein the airflow regulator comprises a back-pressure regulator.

* * * * *